US007124575B1

(12) United States Patent
Franco

(10) Patent No.: US 7,124,575 B1
(45) Date of Patent: Oct. 24, 2006

(54) EXHAUST HEADER MODELING APPARATUS AND METHOD

(76) Inventor: Victor M. Franco, P.O. Box 131383, The Woodlands, TX (US) 77393

( * ) Notice: Subject to any disclaimer, the term of this patent is extended or adjusted under 35 U.S.C. 154(b) by 0 days.

(21) Appl. No.: 10/863,790

(22) Filed: Jun. 8, 2004

(51) Int. Cl.
*F01N 7/10* (2006.01)

(52) U.S. Cl. ..... 60/323; 60/313; 60/322; 60/274; 33/23.11; 33/562; 33/565

(58) Field of Classification Search ..... 60/272, 60/312, 313, 314, 322, 323, 324, 274; 425/295; 33/23.11, 561.1, 562, 565, 566
See application file for complete search history.

(56) References Cited

U.S. PATENT DOCUMENTS 3,889,772 A * 6/1975 Kelley ..... 180/311
4,041,720 A 8/1977 Lebourg
4,593,476 A 6/1986 Clark et al.
4,639,016 A 1/1987 Rogers et al.
5,199,258 A * 4/1993 Barth ..... 60/313
5,579,639 A * 12/1996 Shimoji et al. ..... 60/322
5,907,134 A * 5/1999 Nording et al. ..... 181/228
6,141,958 A * 11/2000 Voss ..... 60/272

* cited by examiner

*Primary Examiner*—Binh Q. Tran
(74) *Attorney, Agent, or Firm*—Kenny A. Roddy

(57) ABSTRACT

An exhaust header modeling apparatus includes a plurality of interchangeable straight and curved short cylindrical segment members which are selectively and releasably joined together end-to-end manually and rotated relative to one another to form a full-scale three-dimensional model of a desired engine exhaust header design or configuration. The segments are provided in sets having outside diameters corresponding to the outside diameters of conventional exhaust header tubing and have a circumferential scale at each end to visually determine the relative rotation between one segment and an adjoined segment. When assembled, the model provides optimum header layout and pathways to accurately fit within an available space, and provides accurate dimensions to aid in cutting forming sections of the exhaust headers from pre-bent metal tubing sections and the proper relative rotation between them.

10 Claims, 2 Drawing Sheets

EXHAUST HEADER MODELING APPARATUS AND METHOD

BACKGROUND OF THE INVENTION

1. Field of the Invention

This invention relates generally to apparatus and methods used in the design and manufacturing of exhaust header assemblies for internal combustion engines, and more particularly to an exhaust header modeling apparatus and method for designing and manufacturing exhaust header assemblies from typical industry-standard metal tubing sections.

2. Background Art

Development of high performance and racing automobile internal combustion engines requires the design, manufacturing and fabrication of special engine components with specific dimensions and shapes. In some instances, these parts are produced in very limited volumes due to the level of involvement, cost and work required.

Exhaust systems fall into this category, more particularly the tubular exhaust headers, which are custom-made exhaust manifolds of equal length constructed of welded sections of straight and bent metal tubing whose purpose is to achieve higher power output by maximizing the evacuation and scavenging of the exhaust gases out of each individual cylinder of the internal combustion engine. Maximum performance is accomplished through the precise and optimized dimensioning of the individual tubing sections, known as the primary runners, such as the overall length of the pipes, their outside diameter and the wall thickness, among others. These dimensions are critical to meet the specific performance and power requirements set for the particular engine design, and the intended application or applications.

For example, racing teams touring different tracks during a racing season may have to tailor their engines' power curves (and gearbox ratios among other options) specifically for each event. Slow speed tracks require strong mid-range torque engines to exit the turns fast. This particular feature in the power curve of an engine is facilitated by exhaust headers having long pipes or primary runners. On the other hand, high-speed raceways demand high rpm horsepower for sustained constant high speeds, which requires relatively short exhaust header primary runners. Sport exhaust headers sold commercially for street vehicles follow many of these same design principles.

During the actual exhaust header design process, some key dimensions are initially calculated, or inferred from experience, such as the outside diameter and length of the primary runners. Later, after prototypes are built, these parameters may be fine-tuned during actual engine testing sessions on a dynamometer or at the track before the final configuration is obtained.

The construction of these exhaust header prototypes pose a significant challenge to the designer and engine builder. Since the location of the endpoints of the primary runners is usually set and fixed early in the process (for example, one end placed at the exhaust ports of the engine and the other end at the primary runner collector section somewhere in the chassis), exploring the numerous possible pipe pathways between such endpoints can become an overwhelming, time consuming and expensive task. The designer needs to find the optimum pipe layout for each cylinder, which also has to fit precisely in the available space, typically using cut sections of pre-bent tubing commercially available and welding them together.

Many prior art methods exist that attempt to find the best pipe routing. A typical method is to approximate the pathway of the pipes using flexible tubing as a model. Then, the resulting shape is divided into sections than can be obtained from existing pre-bent metal tubing. However, this method is inaccurate because it relies entirely on the precision of manually bending the flexible tubing multiple times (which tends to naturally spring back), to simulate the curves of the actual metal tubing. Imprecision in the bending of the model by hand will render the metal prototype useless as soon as the first mismatch is encountered during the process of welding the actual metal tubing sections.

Another prior art method is to utilize wire to create the ideal centerline of the tubing pathways. This approach not only carries the inaccuracies of the previous method, but also fails to take into consideration the interference that will very likely occur by omitting the volume occupied by the pipes themselves. This situation may result in layouts that are impossible to build.

There are several patents directed toward complex and expensive tube bending fixtures and jigs and apparatus for aligning sections of pipe.

Clark et al, U.S. Pat. No. 4,593,476 discloses a computer aided adjustable tube checking fixture system made up of a template placed on a flat metallic surface, and a series of adjustable holding fixtures places at selected positions along the template. The template has a computer aided layout of a plan view of a formed tube inscribed on a film with selected check points along the layout showing the height and angle of the tubing above the check point. Each holding fixture is adjustable as to height and angle, is indexed to align to the check point, and has a switchable on-off magnet in the base to secure the fixture in position.

Rogers et al, U.S. Pat. No. 4,639,016 discloses a system for repairing pipeline, such as underground fuel, gas or water pipeline systems, which have been damaged by explosives, wherein the ruptured sections have been misaligned. Quick-connect fittings are attached to the misaligned pipe ends after trimming and a bridging conduit system is interposed between the fittings having adjustable portions for accommodating the misalignment. Rotative angular sections provide universal adjustment while retaining the fluid-tight integrity of the apparatus.

Lebourg, U.S. Pat. No. 4,041,720 discloses a method and apparatus for installing a spool between misaligned underwater pipeline sections to effect connection thereof, which is based upon the precise determination of the spatial relation between the pipe ends and the determination of an angle of entry of the spool in a direction to avoid binding between the pipe and spool ends.

The present invention provides a solution that offers the designer a simple way to safely and inexpensively build and modify full-scale 3D models as many times as required before any metal cutting or welding takes place. It also yields the exact dimensions to cut each of the required pre-bent metal tubing sections, and the relative rotation between them when the approved prototype is finally welded together.

The present invention is distinguished over the prior art in general, and these patents in particular by an exhaust header modeling apparatus that includes a plurality of interchangeable straight and curved short cylindrical segment members which are selectively and releasably joined together end-to-end manually and rotated relative to one another to form a full-scale three-dimensional model of a desired engine exhaust header configuration. The segments are provided in sets having outside diameters corresponding to the outside diameters of conventional metal tubing typically used for exhaust heater tubing construction, and have a circumferential scale at each end to visually determine the relative rotation between one segment and an adjoined segment. When completed, the model provides an optimum header pipe layout and pathway for a particular engine that accurately fits within an available space, and provides accurate dimensions to aid in cutting and forming sections of the exhaust headers from pre-bent metal tubing sections. It also displays the proper relative rotation between the sections.

SUMMARY OF THE INVENTION

It is therefore an object of the present invention to provide an exhaust header modeling apparatus and method for designing and manufacturing exhaust header assemblies from metal tubing.

It is another object of this invention to provide an exhaust header modeling apparatus and method for designing and manufacturing exhaust header assemblies that allows a person to design and safely and inexpensively build and modify full-scale three-dimensional models of exhaust headers and primary runners as many times as required before any metal cutting or welding takes place.

Another object of this invention is to provide an exhaust header modeling apparatus and method for designing and manufacturing exhaust header assemblies that will permit maximizing the evacuation and scavenging of exhaust gases out of an engine's cylinders.

Another object of this invention is to provide an exhaust header modeling apparatus and method for designing and manufacturing custom exhaust header assemblies that will allow maximizing engine performance through precise and optimized dimensioning of all aspects of the tubing sections to meet specific performance and power requirements set for the particular engine design.

A further object of this invention is to provide an exhaust header modeling apparatus and method for designing and manufacturing exhaust header assemblies that yields the exact dimensions to cut and form sections of the exhaust headers from pre-bent metal tubing sections, and the relative rotation between them.

A still further object of this invention is to provide an exhaust header modeling apparatus that is simple in construction, inexpensive to manufacture and reliable and accurate in operation.

Other objects of the invention will become apparent from time to time throughout the specification and claims as hereinafter related.

The above noted objects and other objects of the invention are accomplished by an exhaust header modeling apparatus that includes a plurality of interchangeable straight and curved short cylindrical segment members which are selectively and releasably joined together end-to-end manually and rotated relative to one another to form a full-scale three-dimensional model of a desired engine exhaust header configuration. The segments are provided in sets having outside diameters corresponding to the outside diameters of conventional metal tubing typically used in the construction of exhaust headers, and have a circumferential scale at each end to visually determine the relative rotation between one segment and an adjoined segment. When completed, the model provides an optimum header pipe layout and pathway for a particular engine that accurately fits within an available space, and provides accurate dimensions to aid in cutting and forming sections of the exhaust headers from pre-bent metal tubing sections. It also displays the proper relative rotation between the sections.

DESCRIPTION OF THE PREFERRED EMBODIMENT

The present exhaust header modeling apparatus includes a plurality of interchangeable straight and curved short cylindrical members or segments which may be selectively and releasably joined together end-to-end and rotated relative to one another to form a full-scale three-dimensional model of a desired engine exhaust header configuration with optimum header layout and pathways that accurately fit within an available space. The modeling apparatus also provides accurate dimensions to aid in cutting and forming sections of the exhaust headers from pre-bent metal tubing sections, and additionally indicates the proper relative rotation between the sections. The straight and curved short cylindrical members or segments are provided in sets having outside diameters corresponding to the outside diameters of conventional metal tubing typically used in the construction of exhaust headers.

Figure 1:
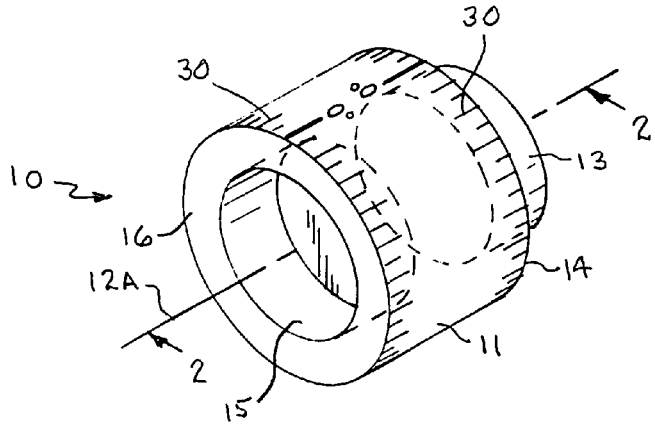
FIG. 1 is an isometric view of a straight segment member of the present exhaust header modeling apparatus in accordance with the present invention.
Figure 2:
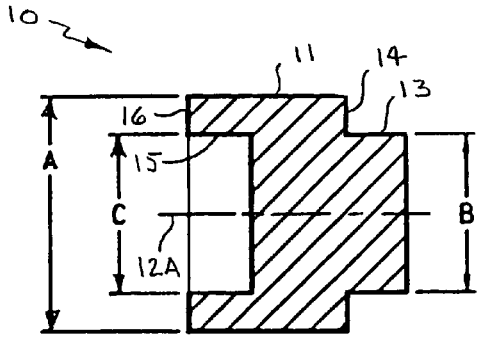
FIG. 2 is a longitudinal cross section of the straight segment member taken along line 2—2 of FIG. 1.

FIGS. 1 and 2 show a typical straight cylindrical member or segment 10 having a larger outside diameter 11 of a size "A" corresponding to the outside diameter of conventional metal tubing typically used in the construction of exhaust headers, for example 1.500" or 1.750", extending along a straight longitudinal center axis 12A, a reduced diameter cylindrical neck portion 13 of a size "B" at one end defining a surrounding flat radial shoulder 14, and a reduced diameter cylindrical socket 15 of a size "C" extending inwardly a short distance from the outer face 16 of the opposed end. In a preferred embodiment of the straight cylindrical segments 10, the distance between the outer face 16 and the flat radial shoulder 14 is about 1.00" in length.

The reduced diameter "C" of the cylindrical socket 15 is sized to receive the diameter "B" of the neck portion 13 of another straight or curved segment, for example, the inside diameter "C" of the cylindrical socket 15 may be 0.005" larger in diameter than the outside diameter "B" of the neck portion 13 to provide a snug friction fit but still allow relative rotation between the segments.

Although the connection at each end of the segments has been described, for purposes of example, as a male and female type connection, it should be understood that other means of releasably connecting the segments may be incorporated. It should also be understood that the neck portion 13 may be provided with a circumferential raised bead and the cylindrical socket 15 may be provided with an interior groove to receive and engage the bead on the neck portion in a "snap fit" arrangement that allows relative rotation.

Figure 3:
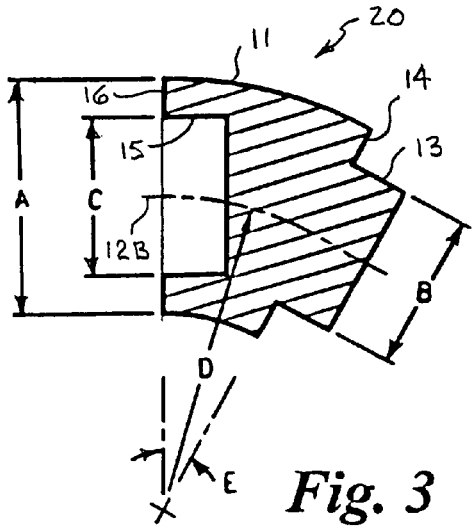
FIG. 3 is a longitudinal cross section of a curved segment member of the exhaust header modeling apparatus in accordance with the present invention.

FIG. 3 shows a typical curved cylindrical member or segment 20 having a larger outside diameter 11 of a size "A"

corresponding to the outside diameter of conventional metal tubing typically used in the construction of exhaust headers, for example 1.500" or 1.750", extending along a curved longitudinal center axis 12B, a reduced diameter cylindrical neck portion 13 of a size "B" at one end defining a surrounding flat radial shoulder 14, and a reduced diameter cylindrical socket 15 of a size "C" extending inwardly a short distance from the outer face 16 of the opposed end. As described above, the inside diameter "C" of the cylindrical socket 15 is sized to receive the outside diameter "B" of the neck portion 13 of another straight or curved segment and allow relative rotation between the segments.

The curved longitudinal center axis 12B of the curved cylindrical segments 20 are provided in a plurality of different radiuses of curvature, typically those of conventional metal tubing used in the construction of exhaust headers. For example, as shown in Table 1 below, curved cylindrical segments 20 of 1.500" or 1,750" O.D. may be provided with radiuses ranging from a 2.00" radius "D" that extends through an included angle "E" of 28.64° between the outer face 16 and the flat radial shoulder 14, to a 6.00" radius that extends through an included angle of 9.54° between the outer face 16 and the flat radial shoulder 14 so that the overall arc length at the centerline or axis 12B is about 1.00".

TABLE 1

| DIMENSIONS FOR SEGMENTS IN INCHES | | | | | | |
|---|---|---|---|---|---|---|
| O.D. "A" | 1.500" or 1.750", etc. | | | | | |
| O.D. "B" | 1.000" | | | | | |
| I.D. "C" | 1.005" | | | | | |
| | Straight | Curved | Curved | Curved | Curved | Curved |
| RADIUS "D" | 0 | 2.000" | 2.500" | 3.000" | 4.000" | 6.000" |
| ANGLE "E" | 0 | 28.64° | 22.91° | 19.10° | 14.32° | 9.54° |

Although for purposes of example, the straight and curved segments 10 and 20 have been illustrated as being of solid construction, it should be understood that they may be of hollow construction having an axially extending generally cylindrical open interior to make the segments and assembly formed thereby as light as possible.

Figure 4:
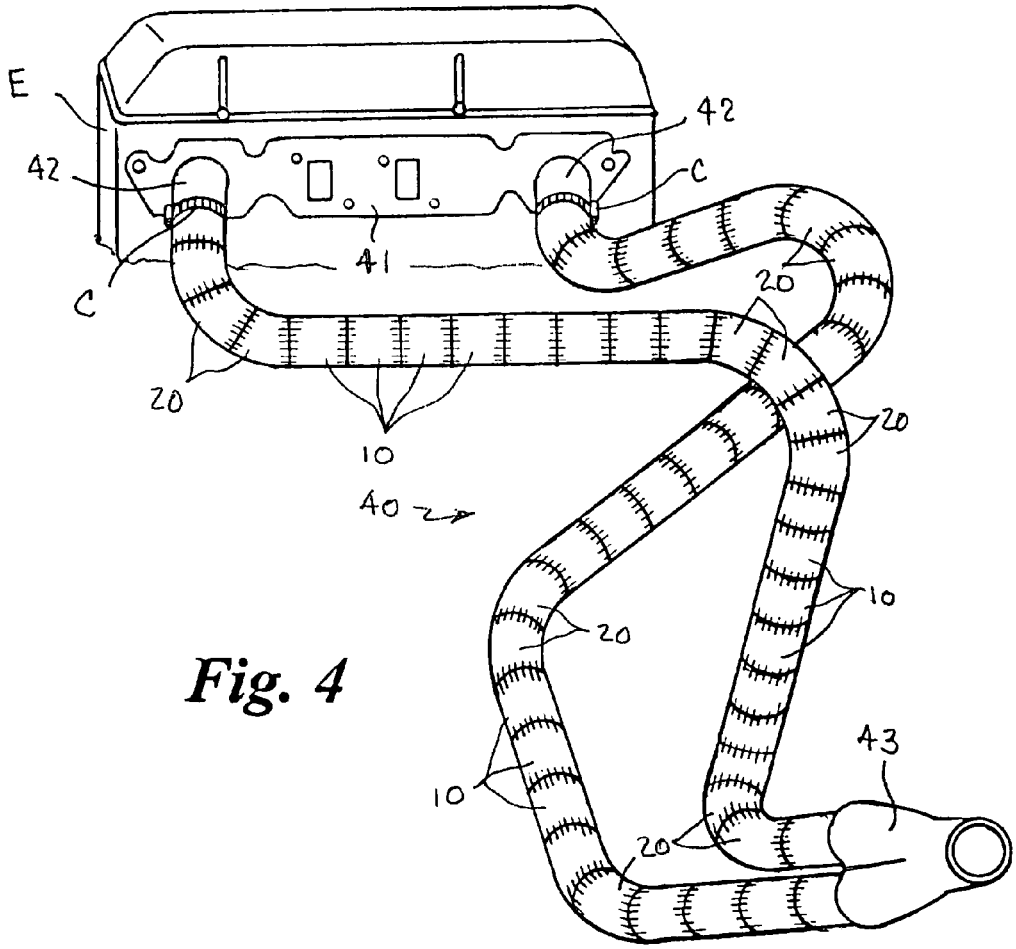
FIG. 4 is a perspective view showing a plurality of the straight and curved segments assembled to form a three-dimensional a model of an engine exhaust header.

Each of the straight and curved cylindrical segments 10 and 20 is provided with a circumferential scale 30 at each end of its larger outside diameter to visually determine the relative rotation between one segment and an adjoined segment. A suitable scale 30 has thirty-six marks or notches circumferentially spaced 10° apart with a 0° mark or notch represented by a dot or other indicia placed consistently in the same location in all segments as a reference point. Thus, the scale 30 visually indicates the angular rotation of one segment relative to an adjoined segment in a full 360° rotational range. As shown in FIG. 4, the user can make an accurate full-scale three-dimensional model 40 of a desired engine exhaust header configuration utilizing the exhaust header modeling segments by selecting the straight and curved segments 10, 20, of the proper outside diameter and manually joining them together end-to-end and rotating them relative to one another to achieve the desired runner length, configuration, optimum layout and pathway for each primary pipe to fit within the available space in and around the engine compartment and existing obstructions. The following is a description of the steps the user would typically take in order to complete the design.

(1) With the exhaust header metal flange 41 and its starter tubes 42 mounted on the engine E, and the primary pipes collector 43 already fixed in their desired locations in the vehicle or along the exhaust system, the starting and end points for the header model become set.

(2) The total required length of each of the runners for the exhaust header design or configuration to be built is determined. This length, in whole inches will indicate the quantity of segment members to use per runner. Typically this length ranges from 15 to 35 inches per runner (or cylinder) for automotive engines.

(3) Utilizing conventional hose clamps C, the user firmly fixes the first header model straight or curved segment to the metal starter tube 42 for each runner.

(4) Beginning with the most challenging runner, the user then begins connecting additional segments and orienting them to build the pathway for each runner one at a time and all the way to its endpoint at the exhaust collector 43. This stage may require an amount of repetition, since it is likely that as the model becomes more complex and more runners are added, more frequent adjustments will be required to clear any obvious interference. Ideally, curves of the largest radiuses are preferred as much as the design allows.

(5) Once the model is completed to the user's satisfaction, the number and type of segments required for each runner and the relative rotation is tallied and recorded. This information will indicate the number of segments, thus, the linear length in metal tubing required to reproduce the section of each of the runners. It will also indicate the relative rotation between one section and the next by keeping track of the radial marks between the zero index of one segment and the adjoining one.

(6) The user then cuts metal tubing sections corresponding to the configuration of the segments from pre-bent metal tubing and begins to replace them in the actual model assembly by tack-welding the first metal sections to the exhaust flange starter tubes 42.

(7) One at a time, additional sections of metal tubing will be added until the actual metal tubing runner is formed.

(8) Finally, the entire runner is welded completely and secured to the exhaust flange on one end and at the exhaust collector at the other.

Thus, the assembled model provides the user with the required length, the bend angles and angles of rotation at known incremental lengths along the length of the assembly for each runner to reproduce the corresponding metal tubing runners.

Because the mating connections 13, 15, at each end of the segments is the same size for the various different outside diameters, the present exhaust header modeling apparatus also allows the user to combine straight and curved segments of different outside diameters to accurately build header models based on the current trend in the performance industry known as "stepped headers ".

Where the "conventional " header consists of bent tubes of a single diameter that extend from the header flange to the collector, the "stepped" header has header tubes that are formed of at least two different diameters of tubing. Typically, the smaller tubing diameter emerges from the header flange port and, at some distance from the header flange, larger diameter tubing is slipped over and welded to the smaller diameter tubing. The location of change in tubing diameter is called a "step" (usually, a "step" UP in diameter). The stepped header arrangement aids in the scavenging of exhaust gases, particularly at very high engine speeds.

Although a preferred method of constructing the header from metal tubing has been described, it should be understood, that in some cases the assembled model may be removed intact and a length of metal tubing may be placed against, or adjacent to, the assembled model and bent as necessary to achieve the configuration of the model.

While this invention has been described fully and completely with special emphasis upon a preferred embodiment, it should be understood that within the scope of the appended claims the invention may be practiced otherwise than as specifically described herein.

What is claimed is:

1. An exhaust header modeling apparatus to aid in designing and constructing engine exhaust header configurations, comprising:

a plurality of interchangeable short straight cylindrical segment members and curved cylindrical segment members, each having an outside diameter of a size corresponding to a known outside diameter of conventional exhaust header tubing, a first end and a second end, and connector means at said first end and at said second end for releasably connecting together said first end of one of said segments to said second end of another one of said segments in end-to-end relation and allowing relative rotation therebetween; and said outside diameter of said straight cylindrical segments extending along a straight longitudinal center axis, and said outside diameter of said curved cylindrical segments extending along a curved longitudinal center axis;

selected said straight and curved segments being releasably connected together end-to-end and manually rotated relative to one another to form a full-scale three-dimensional model of a desired engine exhaust header configuration which is used as a template for forming and constructing an exhaust header configuration from metal tubing.

2. The exhaust header modeling apparatus according to claim 1, further comprising:

scale means at each end of said outer diameter for visually indicating the relative rotation between each of said joined together segments.

3. The exhaust header modeling apparatus according to claim 1, wherein said connecter means at said first end comprises an outwardly extending protrusion and said connector means at said second end comprises a cavity;

said protrusion and said cavity being sized relative one another such that a said protrusion of one of said segments is engaged within a said cavity of another one of said segments to join them together in end-to-end relation and allow relative rotation therebetween.

4. The exhaust header modeling apparatus according to claim 3, wherein said outwardly extending protrusion is a cylindrical protrusion having an outside diameter and said cavity is a cylindrical cavity having an inside diameter sized to receive said outside diameter of said protrusion.

5. An exhaust header model assembly for aiding in the design and construction of an engine exhaust header configuration, comprising:

an assembly of a plurality of short straight cylindrical segment members and curved cylindrical segment members each having an outside diameter of a size corresponding to a known outside diameter of conventional exhaust header tubing joined together in end-to-end relation to allow relative rotation therebetween;

selected said straight and curved segments being manually rotated relative to one another to create a full-scale three-dimensional model of a desired engine exhaust header configuration which is used as a template for forming and constructing an exhaust header configuration from metal tubing.

6. The exhaust header model according to claim 5, further comprising:

scale means at each end of said outer diameter for visually indicating the relative rotation between each of said joined together segments.

7. A method of designing and constructing engine exhaust header configurations, comprising the steps of:

providing a plurality of interchangeable short straight cylindrical segment members and curved cylindrical segment members, each having an outside diameter of a size corresponding to a known outside diameter of conventional exhaust header tubing, a first end and a second end, and connector means at said first end and at said second end;

releasably connecting selected said straight and curved segment members together end-to-end and manually rotating them relative to one another to form a full-scale three-dimensional model of a desired engine exhaust header configuration; and using the model as a template for forming and constructing an exhaust header configuration from metal tubing.

8. The method according to claim 7, wherein each of said segment members has scale means at each end of said outer diameter for visually indicating the relative rotation between each of said joined together segment members; and said step of manually rotating includes the step of visually observing the scale means to determine the relative rotation between each of said joined together segment members.

9. The method according to claim 8, including the further steps of:

disconnecting said segment members;

cutting correspondingly shaped metal tubing segments from sections of straight or pre-bent metal tubing, each having an outside diameter and length substantially the same as said straight and curved segment members;

positioning said correspondingly shaped metal tubing segments end to end and at substantially the same relative rotation therebetween determined by said scale means; and welding said correspondingly shaped metal tubing segments together to form an exhaust header or primary runner from said metal tubing segments.

10. The method according to claim 8, including the further steps of:

placing a length of metal tubing having an outside diameter substantially the same as said connected straight and curved segment members adjacent to said model to visually determine the length, radius of curvature and angular rotation at which it is to be bent to achieve a correspondingly shaped section along its length; and bending said length of metal tubing at increments along its length and repeating the just recited steps as necessary to form said length of metal tubing into an exhaust header or primary runner having substantially the same configurations as said model.

* * * * *